US005927307A

United States Patent [19]

King

[11] Patent Number: 5,927,307

[45] Date of Patent: Jul. 27, 1999

[54] APPARATUS FOR ENVIRONMENTALLY ACCEPTABLE CLEANING OF OIL WELL COMPONENTS

[76] Inventor: Glenn Frederick King, 2002 Hearford, Midland, Tex. 79707

[21] Appl. No.: 08/700,693

[22] Filed: Aug. 13, 1996

[51] Int. Cl.[6] ..... B08B 9/02

[52] U.S. Cl. ..... 134/168 C; 134/169 C; 134/171; 134/199; 166/312

[58] Field of Search ..... 166/312; 134/167 C, 134/168 C, 169 C, 201, 171, 122 R, 199

[56] References Cited

U.S. PATENT DOCUMENTS

| | | | |
|---|---|---|---|
| 3,993,135 | 11/1976 | Sperry et al. | 166/312 |
| 4,187,911 | 2/1980 | Hutchinson et al. | 166/312 |
| 4,193,037 | 3/1980 | Calderon | 166/312 |
| 4,410,041 | 10/1983 | Davies et al. | 166/312 |
| 4,609,041 | 9/1986 | Magda | 166/312 |
| 4,671,359 | 6/1987 | Renfro | 166/312 |
| 5,372,154 | 12/1994 | Bee et al. | 134/167 C |
| 5,458,198 | 10/1995 | Hashemi et al. | 166/312 |

FOREIGN PATENT DOCUMENTS

| | | | |
|---|---|---|---|
| 1458632 | 3/1971 | Germany | 134/167 C |
| 632414 | 11/1978 | U.S.S.R. | 134/167 C |

*Primary Examiner*—Frankie L. Stinson
*Attorney, Agent, or Firm*—Robert W. Jenny

[57] ABSTRACT

Contaminants are removed from oil well components by high pressure jets of hot water. The water and removed contaminants are retained and moved by suction to a holding tank for environmentally acceptable disposal. Rod strings move through a housing assembly which is attached to the pumping tee of the well. Nozzles in the housing assembly apply the water. The water and contaminants are sucked from an outlet in the lower bell cap of the housing assembly. The nipple in the bell cap extends upward at least to the upper edge of the bell cap to prevent water and contaminants from entering the well. Suction is provided by a suction pump which draws air from the holding tank. To decontaminate a tube one end of the tube is sealed off and a tee fitting assembly is attached to the other end. A nozzle fitting on a hose (termed a snake) propels itself through the tube as it removes contaminants. The contaminants and water from the nozzles exit through the tee fitting into a hose to the holding tank. All of the apparatus except the housing assembly and snake is mounted on a trailer.

1 Claim, 3 Drawing Sheets

APPARATUS FOR ENVIRONMENTALLY ACCEPTABLE CLEANING OF OIL WELL COMPONENTS

BACKGROUND OF THE INVENTION

1. FIELD

The subject invention is in the field of methods and apparatus for removing paraffin and asphaltene from the rod string and tubing of oil wells while the rod string is being removed from the well and after removal of the tubing.

2. PRIOR ART

The U.S. patents listed below are a sampling of the patented prior art in this field.

| | |
|---|---|
| 3,475,781 | 4,895,205 |
| 4,279,300 | 5,101,896 |
| 4,399,869 | 5,168,929 |

In prior art apparatus in this field, such as the apparatus of Thompson, U.S. Pat. No. 4,895,205, there is a housing attachable to the head of an oil well. The housing is fitted with nozzles and scrapers. When a string of rods is moved through the housing liquids are sprayed through the nozzles so that, in combination with the action of the scrapers, contamination is removed from the rods. The removed contamination, including paraffin and asphaftene, is deposited either in the well or outside of the housing, thus contaminating the well and/or the environment and equipment around the well head. Contamination of the well may interfere with or prevent reinstallation of equipment in the well, requiring expenditure of money and time to remove the contamination. Decontaminating the equipment and environment around the well head also requires expenditure of time and money and can be hazardous to health of personnel doing the work, particularly when noxious gases art present.

Accordingly, the primary objective of the subject invention is to provide apparatus for cleaning oil well components such as the rod string and tubing without contamination of the well or the environment around it. Other objectives are that the apparatus be dependable and easily transportable.

SUMMARY OF THE INVENTION

The subject invention is apparatus for cleaning oil well components, including removing paraffin and asphaltene from the rods of the rod string of an oil well. The apparatus for cleaning the rod string comprises a housing assembly which is attached to the pumping tee of the oil well and configured so that the rod string passes through the housing as the rod string is lifted from the well for maintenance purposes, including removal of contaminants such as paraffin and asphaltene which have accumulated to the point of causing pumping pressure to be unacceptably high. The housing assembly comprises nozzles for directing water at high temperature and pressure at the rods to remove the contaminants. Scraping devices may also be used in an assembly above the housing to help remove the contaminants. The water and removed contaminants are removed from the housing assembly through a hose by suction and deposited in a holding tank and held for later environmentally acceptable disposal. The vacuum is produced by a suction pump which evacuates air from the holding tank. Equipment termed a snake can be used to dean contaminants from inside the tubing and the contaminants are sucked into the holding tank. The holding tank, suction pump and suction pump driving motor are mounted on a trailer along with a fresh water tank, water heater and water pump which supplies the water to the nozzles.

The invention is described in more detail below with reference to the attached drawings.

DETAILED DESCRIPTION OF THE INVENTION

Figure 1:
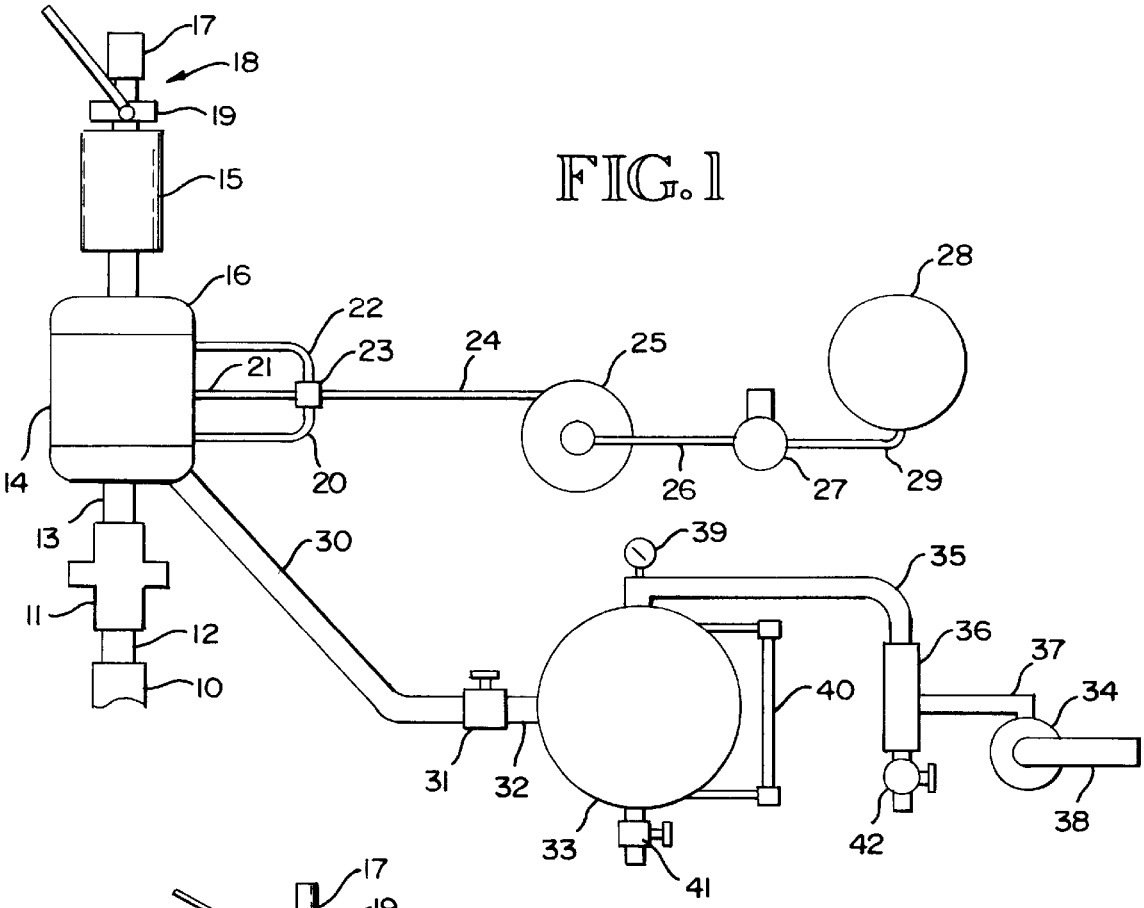
FIG. 1 is a block diagram of the subject apparatus for cleaning a rod string.

The subject invention is apparatus for environmentally acceptable cleaning of oil well components, including removing paraffin and asphaltene from the rods of a rod string as the rod string is removed from the well. FIG. 1 is a block diagram of the apparatus adapted to cleaning the rod string of well 10. Pumping tee 11 is attached to the tubing 12 of the well and nipple 13 of housing assembly 14 attaches the housing assembly to the pumping tee. Rod stripping ram assembly 15 is connected to bell cap 16 of the housing assembly. End 17 of a rod string 18 (not visible in this view) is attached to part 19 known in the trade as an elevator. The rod string extends through the stripping ram assembly, housing assembly, pumping tee and down the tubing. The elevator is used to lift the rod string from the well. As the rod string is removed paraffin, asphaltene and other contaminants are removed from the rods in the string by jets of hot water as explained below. The water is provided through tubes 20, 21 and 22, fitting 23, hose 24 carried on reel 25 and tube 26 from pump 27 which is supplied with water from tank 28 through tube 29.

The water sprayed in the housing assembly and the material removed from the rod string are extracted from the housing assembly through tube 30, valve 31 and hose 32 into holding tank 33 by suction produced by suction pump 34. Air is drawn from the holding tank through hose 35 and passes through scrubber 36 to tube 37 and into the suction pump to be exhausted through tube 38. Gauge 39 indicates the pressure in the holding tank. Sight glass 40 indicates the level of contents of the holding tank. The holding tank is emptied through valve 41. The scrubber is emptied through valve 42.

Figure 2:
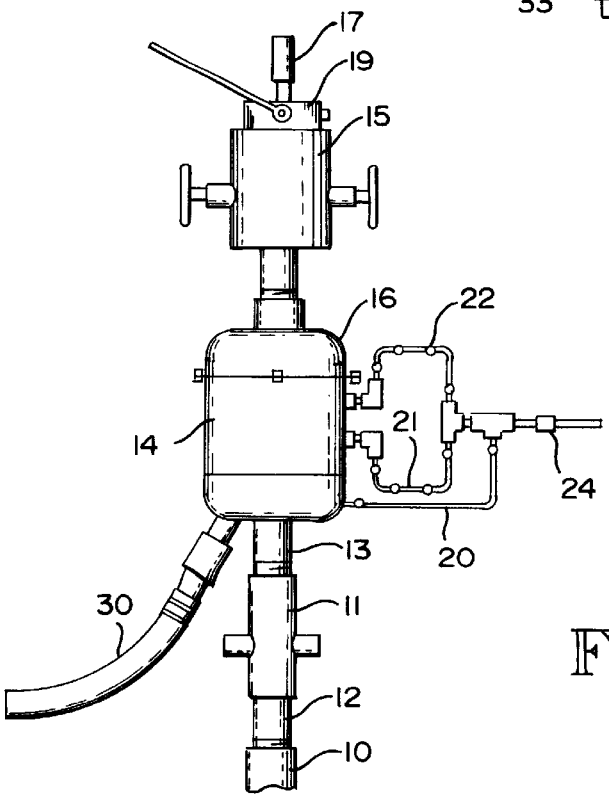
FIG. 2 illustrates the housing assembly and stripping ram assembly installed on the pumping tee.

FIG. 2 illustrates the housing assembly, stripping ram assembly, pumping tee and related plumbing in more detail with parts numbered as in FIG. 1. Any material removed from the rods as they pass through the stripping assembly falls into the housing assembly and is removed by suction.

Figure 3:
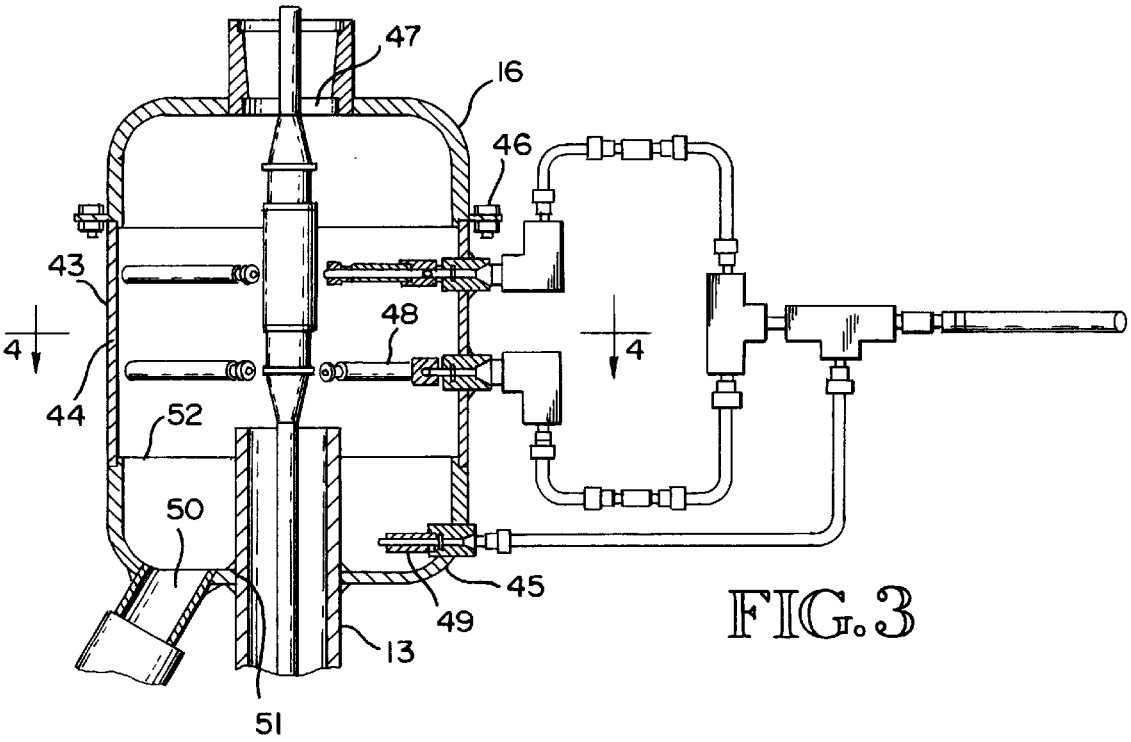
FIG. 3 is a sectional of view of the housing assembly taken through the longitudinal centerline of the housing and parallel to the plane of the water supply tubing.

FIG. 3 is a sectional view of the housing assembly taken through its longitudinal center line and parallel to the plane of the water supply tubing. Housing 43 of the housing assembly comprises a center section 44, upper bell cap 16 and lower bell cap 45. The upper bell cap is removable for service, inspection and cleaning of the housing assembly and is held in place by threaded fasteners, fastener 46 being typical. Hole 47 allows the rod string to pass through the upper bell cap. Heated water is directed onto the rod string by a plurality of nozzles, nozzle 48 being typical. Water from nozzle 49 agitates material which collects in the lower bell cap and helps ensure its evacuation through the outlet 50. Nipple 13 extends upward through hole 51 beyond upper edge 52 of the lower bell cap to prevent the material removed from the rod string from passing through the nipple and into the well.

Figure 4:
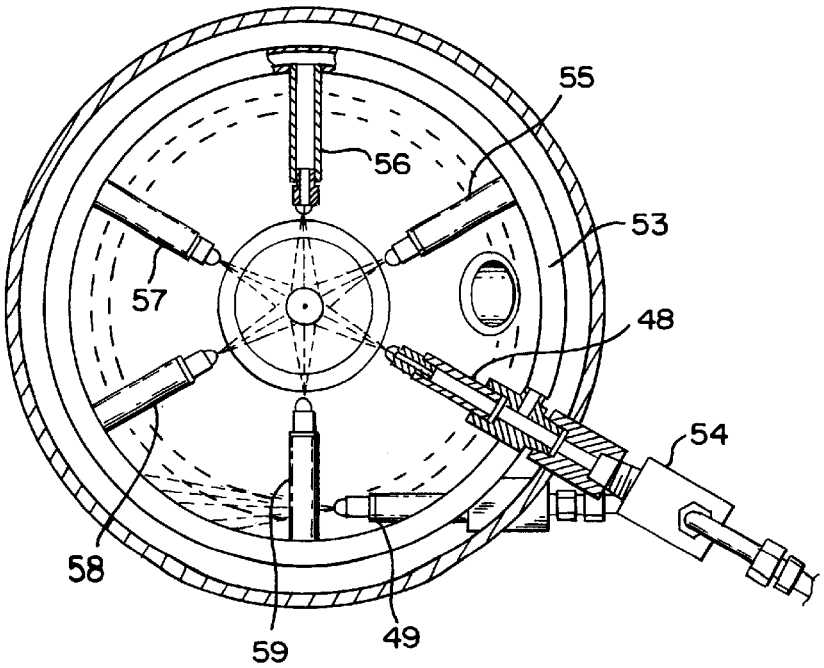
FIG. 4 is a sectional view of the housing assembly taken at 4—4 in FIG. 3 and showing the general arrangement of the nozzles.

FIG. 4 is a sectional view taken at 4—4 in FIG. 3 showing the general arrangement of the nozzles. Manifold 53 distributes water from inlet fitting assembly 54 to nozzles 48, 55, 56, 57, 58 and 59. Nozzle 48 is supplied directly from the inlet fitting. All the nozzles are radially disposed except nozzle 49 which is tangentially oriented.

Figure 5:
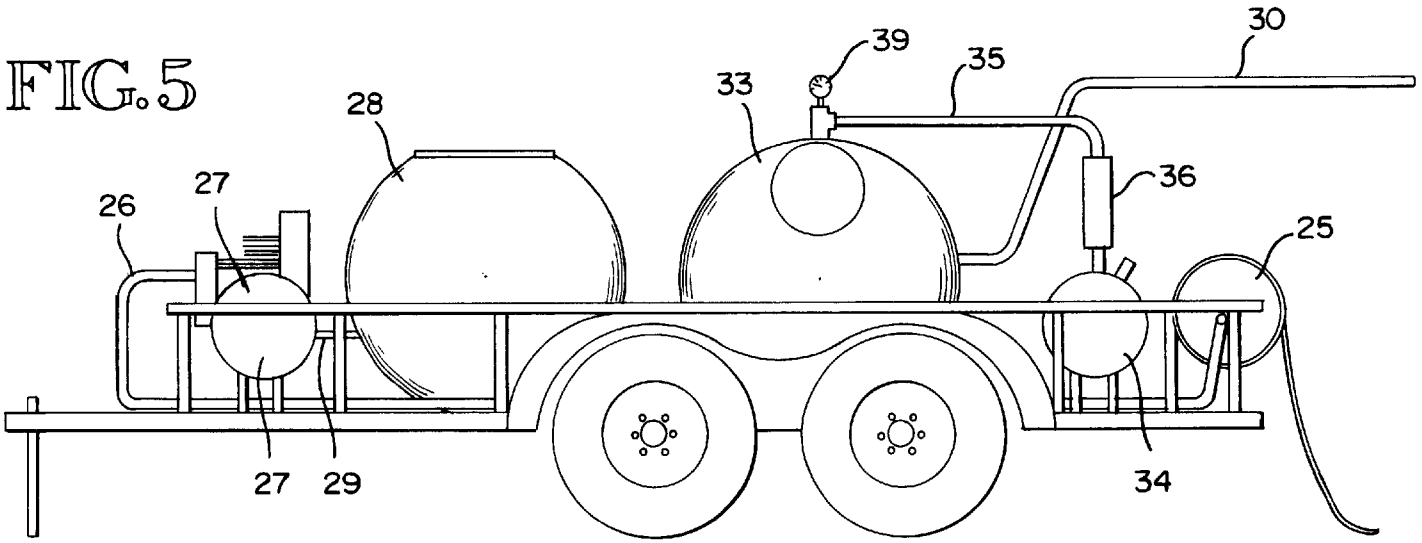
FIG. 5 illustrates the pressurized water and suction producing components of the subject apparatus mounted on a trailer.

All of the components of the subject apparatus except those attached to the pumping tee are mounted on a trailer as illustrated in FIG. 5 in which the components are numbered as in FIG. 1. This equipment can be used in conjunction with equipment used to clean tubing removed from an oil well as explained below. Conventionally the paraffin, asphaltene, etc. removed from the tubes is deposited on nearby terrain. It is difficult and expensive to clean up and therefore may not be cleaned up. Using the subject trailer mounted equipment with the adapter shown schematically in FIG. 6 to clean tubes, all the removed material is captured for proper disposal.

Figure 6:
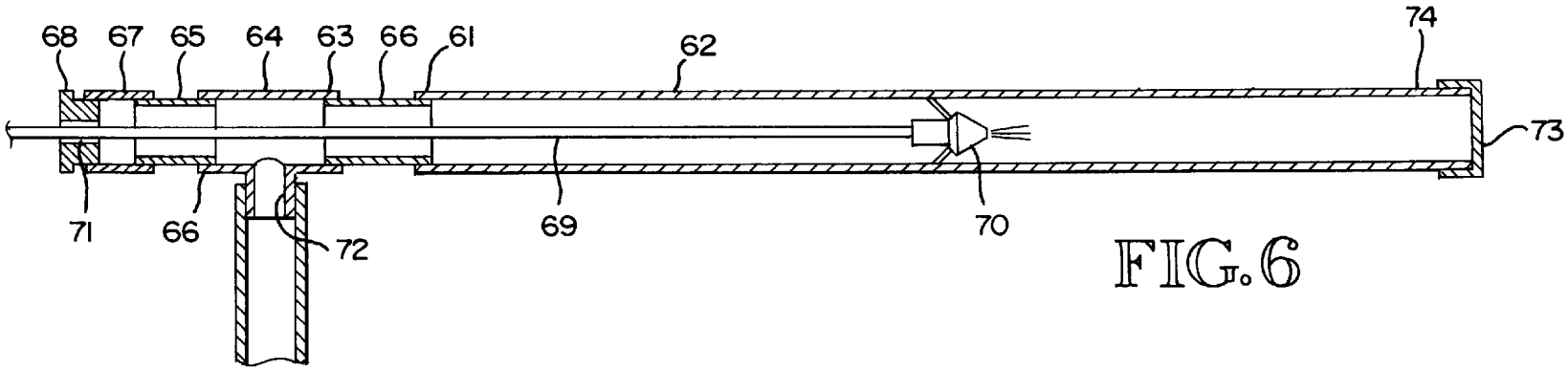
FIG. 6 is a schematic diagram of the subject invention adapted to cleaning a length of tubing.

In FIG. 6 nipple 60 is threaded into end 61 of tube 62. End 63 of tee 64 is threaded onto nipple 60. Nipple 65 is threaded into end 66 of the tee and union 67 connects plug 68 to nipple 65. Equipment termed a snake comprises hose 69 and spray head 70. Hose 69 passes through hole 71 in plug 68. Hose 30 (FIG. 1) is attached to outlet 72 of tee 64. Cap 73 is threaded onto end 74 of the tube. In use hot, high pressure water is delivered through hose 69 to spray head 70. The water dislodges and/or melts contaminants and the water and contaminants are sucked through hose 30 and deposited in the holding tank for environmentally acceptable disposal.

It is considered to be understandable from this explanation that the subject invention meets its objectives. It provides apparatus with which a rod string may be cleaned without contamination of the well or the environment around it. It is dependable because of its simplicity and use of well developed components and it is easily transported from site to site, eliminating the need for such equipment at each site.

It is also considered to be understood that while two embodiments of the invention is described herein, other embodiments and modifications of those described are possible within the scope of the invention which is limited only by the attached claims.

I claim:

1. Apparatus for cleaning oil well components, said components comprising a rod string, said apparatus being used to remove contaminants from said rod string, said apparatus comprising:

a holding tank, means for providing heated water at high pressure, means for using said heated water at high pressure to remove said contaminants from said components, and means for delivering said water used to remove said contaminants and said contaminants to said holding tank, said means for using said heated water at high pressure comprising a housing assembly, said housing assembly further comprising:

an upper bell cap having a first center and first opening at said first center, a lower bell cap having an upper edge, a second center and a second opening at said second center, whereby said rod string can be passed through said housing assembly, a plurality of nozzles oriented to direct said heated water at high pressure onto said rod string to remove said contaminants, said housing assembly further comprising a nipple attached in said second opening and extending at least to said upper edge, and an outlet in said lower bell cap connected to said means for delivering.

* * * * *